US005582537A

United States Patent [19]

Keller

[11] Patent Number: 5,582,537

[45] Date of Patent: Dec. 10, 1996

[54] APPARATUS FOR AND METHOD OF SAND-BLASTING THE INNER WALLS OF BORES, TUBES, PIPES AND THE LIKE

[75] Inventor: Silvano Keller, Böttstein, Switzerland

[73] Assignee: Sulzer Metco AG, Wohlen, Switzerland

[21] Appl. No.: 598,011

[22] Filed: Feb. 7, 1996

[30] Foreign Application Priority Data

Feb. 20, 1995 [CH] Switzerland ..... 484/952

[51] Int. Cl.[6] ..... B24C 3/32

[52] U.S. Cl. ..... 451/76; 451/38; 451/102

[58] Field of Search ..... 451/76, 38, 102, 451/92, 27

[56] References Cited

U.S. PATENT DOCUMENTS 4,380,477 4/1983 Saunders ..... 451/76

4,704,826 11/1987 Kirkland ..... 451/76

*Primary Examiner*—D. S. Meislin

*Assistant Examiner*—George Nguyen

*Attorney, Agent, or Firm*—Tarolli, Sundheim, Covell, Tummino & Szabo

[57] ABSTRACT

The invention provides an apparatus for sand-blasting the inner walls of bores, tubes, pipes and the like, comprising a housing with a first tube member for feeding blasting material and a second tube member for feeding pressurized air. The second tube member is provided with a curved end portion, the orifice thereof being located beyond the outlet opening of the first tube member. The second tube member, together with its end portion, is rotatable around the central longitudinal axis of the first tube member. Thus, the stream of blasting material escaping from the outlet of the first tube member is deflected and accelerated under the influence of the stream of pressurized air escaping from the curved end portion of the second tube member. Due to the provision of such a touchless deflection, the wear of the apparatus can be substantially reduced.

19 Claims, 1 Drawing Sheet

APPARATUS FOR AND METHOD OF SAND-BLASTING THE INNER WALLS OF BORES, TUBES, PIPES AND THE LIKE

FIELD OF THE INVENTION

The present invention refers to an apparatus for sand-blasting the inner walls of bores, tubes, pipes and the like, comprising a housing, a first tube member arranged in the housing for feeding blasting material, and a second tube member arranged in said housing for feeding pressurized air.

The first tube member is provided with an inlet opening adapted to be connected to a source of blasting material and an outlet opening through which a stream of blasting material escapes, and the second tube member is provided with an inlet opening adapted to be connected to a source of pressurized air and an outlet opening through which the pressurized air escapes.

The second tube member further comprises an end portion having an orifice and being connected to the outlet opening for deflecting the jet of air escaping from the outlet opening.

It is understood that the expression "sand-blasting" as used herein after shall not only mean blasting a surface by means of sand, but that expression shall be understood on behalf of any blasting operation using abrasive particulate blasting material.

PRIOR ART

A number of different apparatuses for sand-blasting the inner walls of a bore, a tube or the like are known and in daily use. Since the problems are the same in connection with the inner walls of bores as well as in connection with the inner walls of tubes, the following explanations and comments are restricted to the inner walls of bores.

The difficulty in sand-blasting the inner wall of a bore consists in the fact that the apparatus must be introduced through the opening of the bore into the interior thereof along its central longitudinal axis. However, the blasting material has to hit the wall of the bore under a certain angle. Usually, this angle amounts to between 30° and 90°, measured with reference to the central longitudinal axis of the bore. In order to meet this requirement, the apparatus must be provided with means which deflect the blasting material with reference to the longitudinal central axis of the bore by the afore mentioned angle. Since the blown-out blasting material, according to its definition, has a highly abrasive effect, the known apparatuses are subjected to a substantial wear in the region of the deflection of the blasting material.

Another difficulty in sand-blasting the inner wall of a bore can be seen in the requirement that the wall must be uniformly blasted. Because the blasting material leaves the blasting apparatus usually in the shape of a jet stream hitting only a limited area, the consequence is that not only a linear relative movement between blasting apparatus and wall must be performed along the central longitudinal axis of the bore, but also either the work piece in which the bore is provided, or the blasting apparatus must be rotated around the central longitudinal axis of the bore. Under certain circumstances, both proceedings are connected with severe disadvantages:

In order to rotate the work piece comprising the bore to be treated around the longitudinal central axis of the bore, lavish and complicated installations are required. Rigidly anchored, built-in or very large work pieces cannot be rotated at all. If a work piece comprises a plurality of bores which all have to be treated by sand-blasting, the individual bores have to be treated one after the other one, whereby the work piece has to be clamped again after each treatment, because the work piece in each case has to be rotated about the central longitudinal axis of the bore under treatment. Thus, it is not possible to sand-blast a plurality of bores simultaneously.

To design a sand-blasting apparatus such that the escaping stream of blasting material rotates around the central axis of the apparatus introduces substantial sealing problems, because the blasting material and dust particles, respectively, heavily load the compellingly required rotational bearings of the apparatus, with the result that these bearings are subjected to a very high wear.

The German Patent Document No. 1,142,298 discloses an apparatus for sand-blasting the inner wall of tubes. This apparatus comprises an inner feeding tube for pressurized air and a concentrically mounted outer tube for feeding blasting material. The front ends of both of these tubes open into a common annular outlet nozzle. In the interior of this outlet nozzle, the pressurized air is uniformly deflected toward all sides by 90°. In the region of the outlet nozzle, a plurality of annularly arranged slots are provided through which blasting material is fed to the deflected streams of pressurized air. The air-sand-mixture so formed escapes from the outlet nozzle in the shape of an annular jacket and hits the inner wall of the tube to be treated in perpendicular direction.

The disadvantage of this apparatus may be seen in the fact that the outlet nozzle is subjected to a substantial stress in the region of its slots and its outlet opening and, consequently, wears rapidly. Moreover, since the wearing of such nozzles does not take place symmetrically, the surface to be treated is not evenly sand-blasted. A further disadvantage of this apparatus is that a high pressure drop occurs due to the large outlet cross section, with the result that the air velocity at the outlet of the nozzle is comparatively low. Thus, the maximum kinetic energy of an individual sand particle moved by the stream of pressurized air is relatively small. Finally, a further disadvantage of this apparatus is that it is not possible to replace only the damaged or worn elements, but that the entire apparatus must be replaced. The angle under which the blasting material hits the wall of the tube can also not be varied.

OBJECTS OF THE INVENTION

To overcome these difficulties and disadvantages, it is an object of the present invention to provide an apparatus for sand-blasting the inner walls of bores, tubes, pipes and the like which is subjected to substantially less wear than comparable apparatuses of the prior art and, consequently, has a much longer service life.

It is a further object of the present invention to provide an apparatus for sand-blasting the inner walls of bores, tubes, pipes and the like which renders possible to treat the walls rapidly and evenly.

It is a still further object of the present invention to provide an apparatus for sand-blasting the inner walls of bores, tubes, pipes and the like in which the major operational parameters as, e.g., the angle and the velocity of the stream of blasting material hitting the wall to be treated, can easily be varied.

SUMMARY OF THE INVENTION

In order to meet these and other objects, the present invention provides an apparatus for sand-blasting the inner walls of bores, tubes, pipes and the like, comprising a housing, a first tube member arranged in the housing for feeding blasting material, and a second tube member arranged in said housing for feeding pressurized air.

The first tube member is provided with an inlet opening adapted to be connected to a source of blasting material and an outlet opening through which a stream of blasting material escapes, and the second tube member is provided with an inlet opening adapted to be connected to a source of pressurized air and an outlet opening through which the pressurized air escapes.

The second tube member further comprises an end portion. The end portion has an orifice and is connected to the outlet opening for deflecting the jet of air escaping from the outlet opening. The second tube member is rotatable around the central longitudinal axis of the first tube member.

Thereby, the arrangement is such that the orifice of the end portion of the second tube member is located downstream beyond the outlet opening of the first tube member. Thus, the pressurized air escaping from the outlet opening of the second tube member deflects the stream of blasting material escaping from the outlet of the first tube member.

By the provision of a pressurized air feeding tube member having a curved end portion located downstream beyond the outlet of the feeding tube member for blasting material and rotatable around the central longitudinal axis of the feeding tube member for blasting material, the blasting material can be evenly distributed along a full circle without the need to provide means for deflecting the blasting material in the feeding tube member for blasting material. Due to this touchless deflection of the stream of blasting material, the wear of the sand-blasting apparatus in the region of the outlet of the blasting material tube member is substantially reduced or even fully avoided.

According to a preferred embodiment, the first tube member for feeding blasting material is torsionally fixedly mounted in the housing. Thereby, the need is removed to realize a transition from a stationary part to a rotary part which always presents great difficulties.

According to another preferred embodiment, the end portion of the feeding tube member for pressurized air comprises a curved tube section which is of modular design and is releasably attached to the outlet opening of the feeding tube member for pressurized air. By replacing this tube section by another one having a different design, certain operating parameters of the apparatus can easily be varied. For example, the deflection angle of the blasting material as well as the shape of the stream of blasting material can be influenced by differently designed end sections.

The present invention further refers to a method of sand-blasting the inner walls of bores, tubes, pipes and the like, in which the blasting material is fed by means of a feeding tube means. The method comprises the step of deflecting the blasting material after its escaping from the feeding tube by means of a pressurized air jet rotating around the feeding tube member for blasting material. Thereby, the blasting material can be further accelerated by means of the pressurized air jet escaping from the feeding tube member.

Preferably, the blasting material is deflected with reference to the axis of rotation of the pressurized air jet by 30° to 90°, more preferably by 50° to 80°. Thereby, the deflection angle of the blasting material can be controlled by the angle under which the pressurized air jet hits the blasting material or by the velocity of the pressurized air jet or by both measures simultaneously.

SHORT DESCRIPTION OF THE DRAWINGS

In the following, an embodiment of the apparatus according to the invention will be further described, with reference to the accompanying drawings, in which FIG. 1 shows a partially schematic longitudinal sectional view of an embodiment of an apparatus for sand-blasting the inner walls of bores, tubes, pipes and the like, and FIG. 2 shows a sectional view of the apparatus according to FIG. 1, taken along the line A—A in FIG. 1.

DETAILED DESCRIPTION OF A PREFERRED EMBODIMENT

Figure 1:
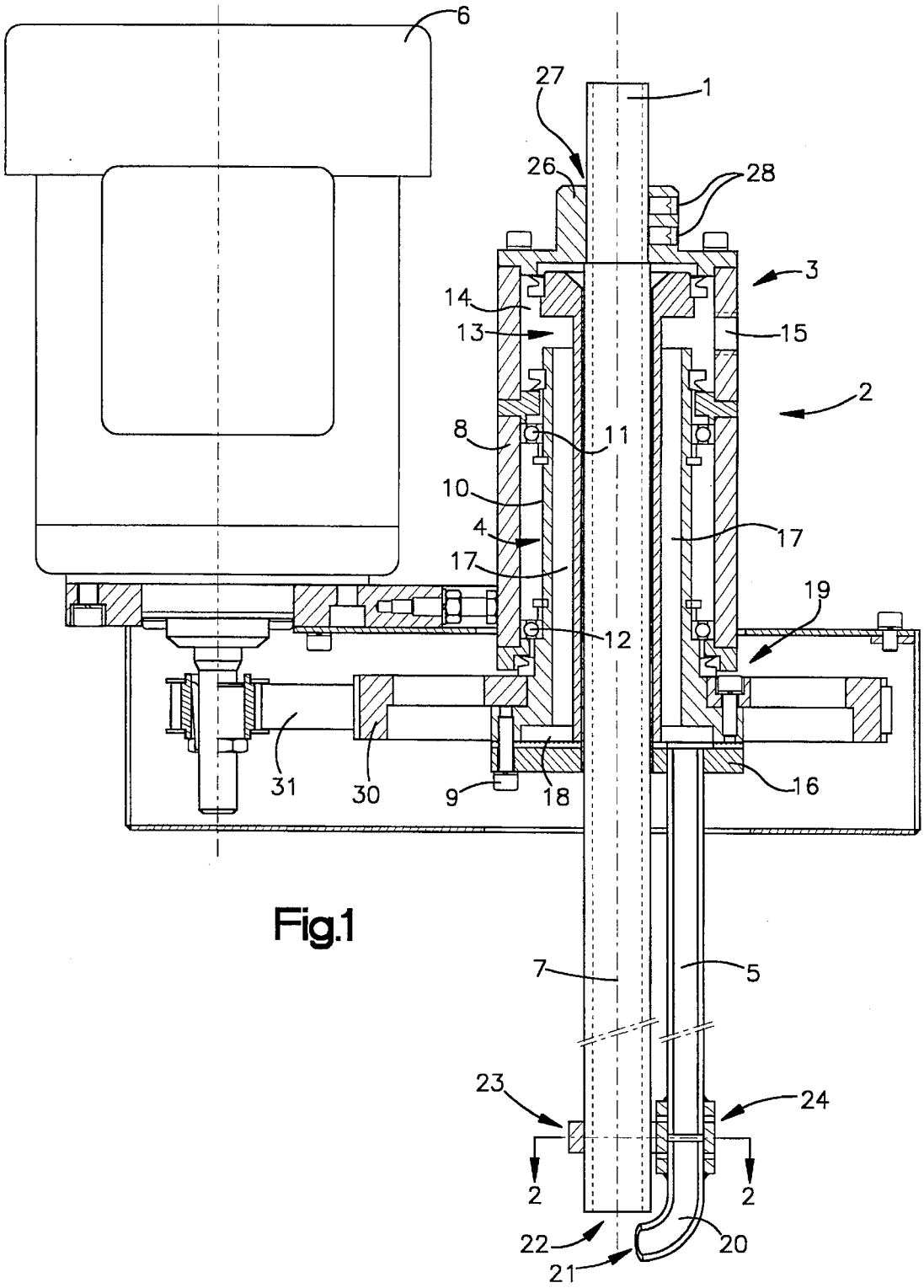

The apparatus for sand-blasting the inner walls of bores, tubes, pipes and the like shown in a partially schematic sectional view in FIG. 1 comprises a central feeding tube 1 which is connected to a source of blasting material (not shown) and through which the blasting material, usually sand, is fed under pressure by suitable pressure generating means known per se in the art and not shown in the drawing. The apparatus further comprises a main body member 2, including a stator member 3 and a rotor member 4 rotatably mounted in coaxial manner in the interior of the stator member, as well as a feeding tube 5 for pressurized air, mounted on the rotor member 4 of the main body member 2. The feeding tube 5 is connected to a source of pressurized air (not shown) and the air is fed under pressure through the feeding tube 5 by suitable pressurized air generating means known per se in the art and not shown in the drawing. Moreover, there is provided a schematically shown electric motor 6 for rotating the rotor member 4.

The stator member 5 of the main body member 2 comprises an essentially cylindrically shaped housing 8, and the rotor member 4 is constituted by, as seen in a cross sectional view, an essentially T-shaped body member 10. The rotor member 4 is rotatably mounted in the interior of the housing 8 by means of bearings 11 and 12, and a lower portion 19 thereof projects from the housing 8.

For feeding pressurized air from the stator member 5 to the rotor member 4, an upper portion of the rotor member 4 is provided with a circumferential groove 13 which forms, together with the inner wall of the housing 8, an upper annular cavity 14. At the height level of this groove 13, the housing 8 is provided with a radially extending connecting bore 15 running through the wall of the housing 8. Attached to the connecting bore 15 is a (not shown) pipe leading to the above mentioned source of pressurized air. Moreover, the rotor member 4 is provided with a plurality of longitudinally extending bores 17, merging into a lower annular cavity 18 provided in the region of the lower end of the rotor member 4. Thus, the above mentioned annular groove 13 communicates with the lower annular cavity 18 for allowing pressurized air to pass from the connecting bore 15 through the bores 17 into the lower cavity 18.

Connected to the lower face of the rotor member 4 is the feeding tube 5 for pressurized air. As can be seen in FIG. 1, a flange member 16 is connected to the lower face of the rotor member 4 by means of screw members 9, and the feeding tube 5 for pressurized air is rigidly attached, e.g. by welding, to the flange member 16 such as to be eccentrically located with reference to the axis of rotation 7 of the rotor member 4. The feeding tube 5 for pressurized air runs through the flange member 16, and its upper orifice communicates with the lower annular cavity 18.

The feeding tube 5 for pressurized air runs essentially parallel to the central feeding tube 1 for blasting material and is provided, at its lower end, with a curved end portion 20. The curved end portion 20 extends along a central angle of approximately 80° towards the central, stationary feeding tube 1 for blasting material. The orifice 21 of the curved end portion 20 is located beyond the outlet opening 22 of the central feeding tube 1 for blasting material, i.e. below that outlet opening 22 as seen in FIG. 1.

The rotatable feeding tube 5 for pressurized air is fixed to the stationary central feeding tube 1 for blasting material by means of a collar member 23 located in the region of the lower end of the stationary central feeding tube 1 for blasting material. The curved end portion 20 is attached to the feeding tube 5 for pressurized air in the region of this collar member 23 by means of a screwed connection 24. If the screwed connection 24 is released, the curved end portion 20 can be removed and replaced by another curved end portion, having e.g. a different angle of curvature.

Figure 2:
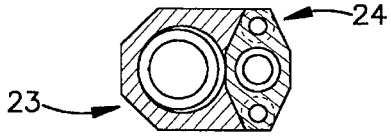

FIG. 2 shows, in a cross sectional view taken along the line A—A in FIG. 1, the collar member 23 which serves for fixing the feeding tube 5 for pressurized air to the central feeding tube 1 for blasting material and for attaching the curved end portion 20 to the end of the feeding tube 5 for pressurized air.

The upper end of the housing 8 is provided with a flange member 26 provided with a central bore 27. The central feeding tube 1 for blasting material extends through this central bore 27 and is torsionally fixed to the flange member 26 by means of two threaded pins 28. The central feeding tube 1 for blasting material is located such that its central longitudinal axis coincides with the axis of rotation 7 of the rotor member 4 and, thereby, also with the axis of rotation of the feeding tube 5 for pressurized air. Tills design allows for a symmetrical distribution of the blasting material during the operation of the apparatus.

The lower portion 19 of the rotor member 4 projecting from the housing 8 is provided with a toothed wheel member 30. The toothed wheel member 30 is coupled to the schematically shown electric motor 6 by means of a toothed belt 31. Thus, upon operation of the electric motor 6, the rotor member 4 can be driven to a rotational movement in a manner known per se.

It should be mentioned that a pneumatic motor could be provided instead of the electric motor 6. Thereby, the pressurized air fed through the feeding tube 5 for pressurized air could also be used for the operation of the pneumatic motor. Such a design is well known to any person skilled in the art and must not be explained in detail.

As already mentioned, the central feeding tube 1 for blasting material can be connected, e.g. by means of a hose assembly, to a stock container for blasting material. For clarity's sake, neither the stock container nor the hose assembly are shown in the drawing since such a design is well known to any person skilled in the art.

The operation of the apparatus according to the invention is as follows:

The pressurized air required for performing the blasting operation is fed via a (not shown) pipe from a (not shown) source of pressurized air to the connecting bore 15 radially running into the interior of the housing 8. Therefrom, it enters the upper annular cavity 14 and flows from the upper cavity 14 through the longitudinal bores 17 provided in the rotor member 4 into the lower annular cavity 18. Finally, the pressurized air enters the feeding tube 5 for pressurized air connected to the rotor member 4. At the end of the feeding tube 5 for pressurized air escapes the pressurized air through the orifice of the curved end portion 20.

The blasting material is fed from a (not shown) stock container via a (not shown) hose assembly to the central feeding tube 1 for blasting material and escapes therefrom through the outlet opening 22. The feeding of the blasting material is usually accomplished by means of a carrier gas, e.g. air. Under the influence of the pressurized air escaping from the curved end portion 20 of the feeding tube 5 for pressurized air, the stream of blasting material escaping from the outlet opening 22 of the central feeding tube 1 for blasting material is deflected and accelerated.

Since the feeding of the blasting material is accomplished by means of a carrier gas, it is possible to operate the apparatus according to the invention in any arbitrary position. Moreover, it is also possible to feed the blasting material through the central feeding tube 1 for blasting material under the influence of subatmospheric pressure.

If the rotor member 4 and, thereby, the feeding tube 5 for pressurized air including its curved end portion 20 is rotated around the central longitudinal axis 7 of the apparatus, the jet of pressurized air escaping from the rotating curved end portion 20 of the feeding tube 5 for pressurized air in a direction transverse to the axis of rotation of the rotor member 4 is moved around the axis of rotation 7 along a path which is circular with reference to the outlet opening 21 of the curved end portion 20. Under the influence of this air jet moving along a circular path, the blasting material escaping from the central feeding tube 1 for blasting material is deflected in a direction transverse to the axis of rotation 7 of the rotor member 4 and simultaneously accelerated in a direction towards a (not shown) wall portion to be treated by the blasting material. In this way, it is easily possible the sand-blast the inner walls of bores, tubes, pipes and the like.

In an apparatus for sand-blasting the inner walls of bores, tubes, pipes and the like, which comprises the characteristics of the present invention, the wear in the region of the outlet of the central feeding tube 1 for the blasting material can be considerably reduced, because the blasting material is deflected and accelerated only after having escaped the feeding tube 1. Since only the feeding tube 5 for pressurized air is rotatably mounted, all disadvantages occurring in connection with the bearing and sealing of tube members conducting highly abrasive blast materials can be fully eliminated.

According to a further embodiment, which is not shown in the drawings nor described in more detail, it could be possible to provide an assembly of several blasting material constructed in accordance with the present invention side by side or to provide a multiple blasting apparatus. By means of such a multiple apparatus, for example several or all cylinder walls of an engine block could be treated in one operating step.

In order to change the angle and the velocity of the stream of blasting material hitting the wall to be treated, the following parameters can be varied:

- the escape velocity of the blasting material leaving the feeding tube;
- the amount of blasting material;
- the average mass of the blasting material particles;
- the velocity of the air jet and the pressure of the air, respectively;
- the hitting angle of the air jet onto the stream of blasting material; this parameter can be influenced by changing the angle of curvature of the end portion 20.

By varying one or several of the afore mentioned parameters, it is possible to optimally and efficiently treat the inner walls of bores, tubes, pipes and the like having different diameters. In practice, however, it has been shown that it is sufficient in most cases to vary but the velocity of the air and/or the escaping angle of the air jet.

In order to avoid that scattered blasting material particles adhere to the wall to be treated, it is preferred to deflect the blasting material escaping from the outlet 22 of the tube 1 by means of the air jet escaping from the curved end portion 20 of the feeding tube 5 for pressurized air by an angle of about 50° to 70°.

What is claimed is:

1. An apparatus for sand-blasting the inner walls of bores, tubes, pipes and the like, comprising:

a housing means;

a first tube means arranged in said housing for feeding blasting material, having a central longitudinal axis, an inlet opening adapted to be connected to a source of blasting material, and an outlet opening through which a stream of said blasting material escapes;

a second tube means arranged in said housing for feeding pressurized air, having an inlet opening adapted to be connected to a source of pressurized air, and an outlet opening through which said pressurized air escapes;

said second tube means being provided with an end portion having an orifice and connected to said outlet opening for deflecting the jet of air escaping from said outlet opening;

said second tube means being rotatable around said central longitudinal axis of said first tube means;

said orifice of said end portion of said second tube means being located downstream beyond said outlet opening of said first tube means such that said pressurized air escaping from said outlet opening of said second tube means deflects said stream of blasting material escaping from said outlet of said first tube means.

2. An apparatus according to claim 1 in which said first tube means is torsionally fixedly mounted in said housing and being, at least in the region of its outlet, of straight configuration.

3. An apparatus according to claim 1 in which said end portion comprises a curved tube means section which is of modular design and being releasably attached to said outlet opening of said second tube means.

4. An apparatus according to claim 1 further comprising means for supporting an end portion of said second tube means on an end portion of said first tube means.

5. An apparatus according to claim 1, further comprising an electrically or pneumatically operated driving means for rotating said second tube means around said central longitudinal axis of said first tube means.

6. An apparatus according to claim 1 in which said housing means comprises a main body member incorporating a stator means and a rotor means having an axis of rotation coinciding with said central longitudinal axis of said first tube means, said second tube means being fixed to said rotor means at a location offset to said axis of rotation.

7. An apparatus according to claim 6 in which said first tube means is torsionally fixedly mounted on said stator means.

8. An apparatus according to claim 6 in which said main body member comprises a first annular cavity communicating with a connecting bore for pressurized air provided in said stator means, in which said rotor means comprises a second annular cavity and a plurality of longitudinal bores connecting said second annular cavity to said first annular cavity, and in which said second tube means for feeding pressurized air is connected to said second annular cavity.

9. An apparatus according to claim 3 in which said curved tube means section extends over a central angle of 30° to 90°.

10. An apparatus according to claim 3 in which said curved tube means section extends over a central angle of 50° to 70°.

11. An apparatus according to claim 5 in which said rotor means comprises an end portion projecting from said stator means, said end portion being provided with coupling means adapted to be operationally connected to said electrically or pneumatically operated driving means.

12. An apparatus according to claim 11 in which said coupling means comprises a toothed wheel member.

13. A method of sand-blasting the inner walls of bores, tubes, pipes and the like, in which the blasting material is fed by means of a feeding tube means, comprising the step of deflecting the blasting material after its escaping from the feeding tube by means of a pressurized air jet rotating around said feeding tube means for blasting material.

14. A method according to claim 13 in which said blasting material is accelerated by means of said pressurized air jet escaping from said feeding tube means.

15. A method according to claim 13 in which said blasting material is deflected with reference to the axis of rotation of said pressurized air jet by 30° to 90°, preferably by 50° to 80°.

16. A method according to claim 13 in which the deflection angle of the blasting material is controlled by the angle under which said pressurized air jet hits said blasting material.

17. A method according to claim 13 in which the deflection angle of the blasting material is controlled by the velocity of said pressurized air jet.

18. A method according to claim 13 in which the deflection angle of the blasting material is controlled by the angle under which said pressurized air jet hits said blasting material and by the velocity of said pressurized air jet.

19. A method according to claim 13 in which said blasting material is fed by means of pressurized air.

* * * * *